United States Patent [19]

Gelin

[11] 3,966,133

[45] June 29, 1976

[54] TENSION CONTROLLING APPARATUS

[75] Inventor: Robert J. Gelin, Newark, Ohio

[73] Assignee: Owens-Corning Fiberglas Corporation, Toledo, Ohio

[22] Filed: Dec. 23, 1974

[21] Appl. No.: 535,621

[52] U.S. Cl. ..... 242/42; 242/45; 242/154

[51] Int. Cl.[2] ..... B65H 54/02; B65H 59/30; B65H 77/00

[58] Field of Search ..... 242/154, 153, 42, 45, 242/147 R, 149

[56] References Cited

UNITED STATES PATENTS

| | | | |
|---|---|---|---|
| 1,089,790 | 3/1914 | Rand | 242/154 |
| 1,882,539 | 10/1932 | Anderson | 242/153 |
| 2,160,763 | 5/1939 | Taylor et al. | 242/154 |
| 2,732,142 | 1/1956 | Grein | 242/45 |
| 3,072,360 | 1/1963 | Cruz | 242/154 |
| 3,249,312 | 5/1966 | Current | 242/42 |

*Primary Examiner*—Stanley N. Gilreath
*Attorney, Agent, or Firm*—John W. Overman; Kenneth H. Wetmore

[57] ABSTRACT

Apparatus for packaging roving from a plurality of continuous glass strands. The apparatus comprising means for tensioning the roving along its path to the collector including a first and a second bar in spaced relation located at opposite sides of the path and upon which the roving is turned during its travel to the collector. The apparatus also having means to movably hold one of the bars and to control the movement and position of the bar so that the tension in the roving can be varied and controlled as the roving is wound on the collector.

5 Claims, 3 Drawing Figures

TENSION CONTROLLING APPARATUS

BACKGROUND OF THE INVENTION

This invention relates to a tension controlling device for tensioning roving before it is wound into a package.

Generally today roving is tensioned by passing it over and under a series of parallel tensioning or spreader bars. The bars are fixedly held in relationship to each other. These bars impart tension in the roving as it travels to the winder. Tension is varied by adding or subtracting bars.

But the tension in the roving is not controlled.

While a package is being wound the tension in the roving will vary up and/or down. Also, the tension can vary from package to package. All of the sources of this varying tension are not known. But it is known that the bars change temperature and that the bars collect binder, dirt and fuzz on their surfaces during the winding of packages. These changes will alter the coefficient of friction of the bar surfaces resulting in a change in roving tension. Also, strand supply packages can vary in binder content and in how tightly they are wound. So the amount of pull needed to remove strand from the package can vary from strand package to strand package or even within a single strand package resulting in varied strand and roving tension.

Roving packages which are wound with varying tension are a problem. The package will have a varying density. Areas of high density will result when the tension is high, and areas of low density will result when the tension is low.

A roving package made with varying tension may not have flat ends. Rather it can have high and low areas on its ends. Nonuniform package ends can result in poor package run-out of the strand because the strand can become tangled.

If a package is wound with a high tension on the roving when winding the outside of the package, the center portion of the package may be crushed or the center portion of the package can pop (telescope) out. Also, a package with a high density outside is likely to collapse during run-out of the roving during use of the package. This would cause the remaining portion of the package to be scrapped.

An area of the package wound with a low tension on the roving can also be a problem. That area of the package may collapse resulting in a ruined package. A low tension area can slough off and tangle during package use when the roving is being pulled out. This would cause the remaining portion of the package to be scrapped.

These areas have all been problems with the current 30–50 pound roving packages.

But these problems become even more critical when making large roving packages. Today many roving packages that weigh 350–500 pounds are being wound and sold. It can readily be seen that ruining one of these large packages or collapsing one of these large packages before full run-out (by the user) would be a serious problem.

Clearly better tension control is needed today in the winding of roving packages.

SUMMARY OF THE INVENTION

Generally speaking, the apparatus relates to the packaging of roving. Strand material such as bundles of glass fibers are supplied and gathered into a roving such as a glass fiber roving. The roving passes through a tensioning device to a collector where the roving is wound into a package. The tensioning device including tensioning members which are movable in relation to other tensioning members controls the amount of tension in the roving. The tension in the roving can be controlled at a constant level or at changing levels according to a program.

Accordingly, it is an object of this invention to have roving advance through a roving packaging operation at a predetermined controlled tension.

Another object of this invention is to be able to wind a roving package at a constant tension.

A further object of this invention is to be able to wind a roving package at changing tensions according to a predetermined program.

These and other objects and advantages of the invention may be readily ascertained by referring to the following description and appended illustrations.

DESCRIPTION OF THE PREFERRED EMBODIMENTS

Figure 1:
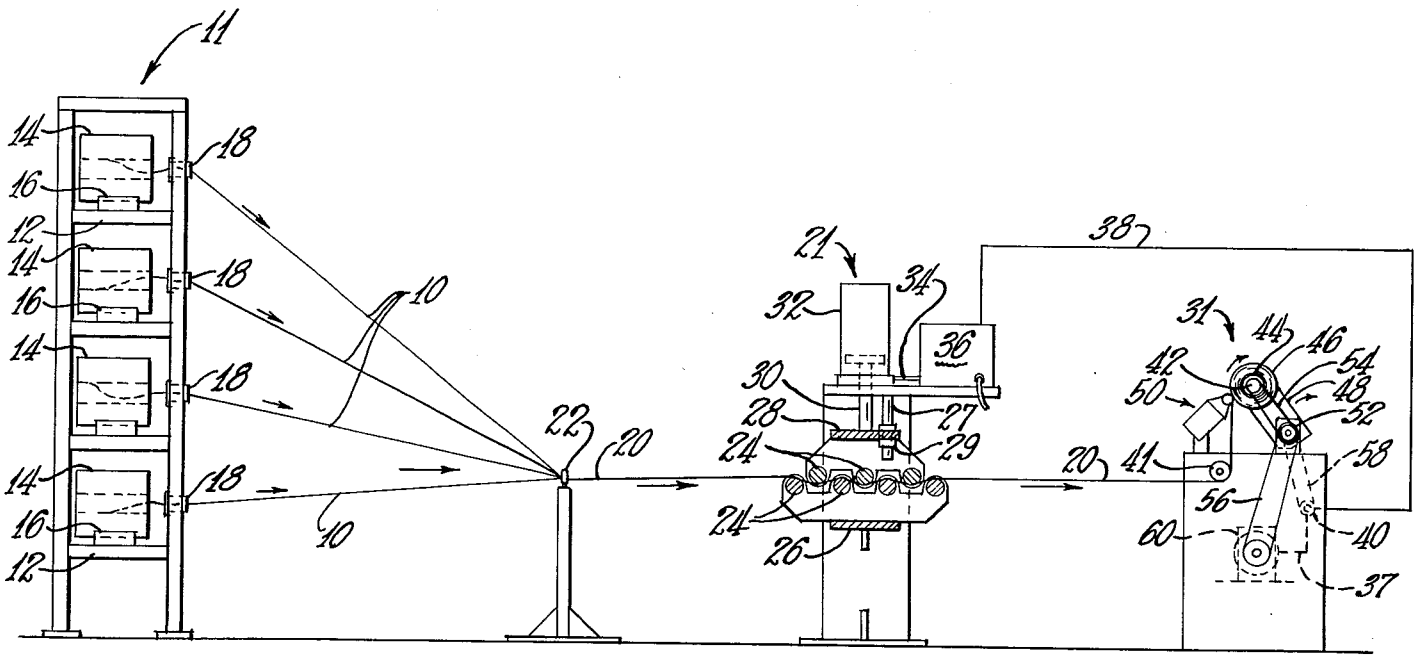
FIG. 1 is a semi schematic front elevation view of strand being pulled from a creel, gathered into a roving, advanced through the tensioning device, and wound into a roving package.

FIG. 1 shows strand being pulled from a creel, gathered into a roving, advanced through the tensioning device, and wound into a roving package.

The creel 11 is shown to have four strand packages 14. These strand packages 14 are held by the support member 16 in the framework 12 of the creel 11. Although only four packages are shown, it is understood that many packages could be used. Thirty packages and more are common in practice.

The strand 10 is pulled from the package 14 through a guide 18. The strand 10 can be monofilament or multifilament and can be composed of organic or mineral material. For example the strand 10 can be a multifilament glass fiber strand.

The strands 10 move from the creel 11 to a gathering guide 22 where they are combined into a roving 20. The roving 20 is shown to be four gathered strands but could, of course, be one strand or a gathering of many strands. The roving 20 then travels along a path through the tension control device 21 to the collector 31.

The roving 20 passes through the tension control device 21 where the roving 20 is controllably tensioned. Tensioning members 24 are shown on both sides of the roving along its path of travel to the collector 31. The roving contacts and passes over some tension members 24 and contacts and passes under some tension members 24. While the roving 20 turns or bends upon the tensioning members 24 the tension in the roving is controlled. The tensioning members 24 can be bars and the bars can be made to or allowed to rotate. For example the bars can be positively rotated round bars of brass.

A portion of the tensioning members 24 can be held on a fixed axis. In FIG. 1 the lower four members 24 are shown this way.

The upper three tensioning members 24 in FIG. 1 are held in movable relationship with members on fixed axis. The roving contacts the members and turns or bends over the four lower members and turns or bends under the three upper members. The movable upper members 24 are yieldably biased into the roving 20. Thus, tension is imparted in the roving as it moves between the members.

The upper three tensioning members 24 in FIG. 1 are held by the support 28. As shown, all of the seven tension members 24 are in parallel relationship. They can be in nonparallel relationship as long as they are all disposed transverse to the path of travel of the roving 20 to the collector 31. The support is attached to a piston 30 which is controllably moved by a cylinder 32. As the cylinder 32 moves the piston 30, the upper three tensioning members are moved up and down. When the cylinder 32 moves the three tensioning members 24 down into the roving, the force of the cylinder 32 exerts a force biasing the three members 24 onto the roving 20. A greater or lesser force by the cylinder will cause a greater or lesser respective force by the three members into the roving. Thus, for example, with a greater force there is more bending or turning by the roving 20 upon all of the members and so there is more contact by the roving on the members. This greater force will thereby cause a greater tension in the roving 20. If the force exerted by the three moveable members biasing the roving is lowered, the tension (turning or bending and contact being lower) in the roving 20 as it travels to the collector 31 will be lowered.

The cylinder 32 can be an air cylinder. In practice a double acting type air cylinder such as that sold by Bellofram Corporation in Burlington, Massachusetts has been satisfactory. This is a rolling diaphragm type cylinder which is very sensitive to small changes in air pressure. So it is possible to make small controlled changes in the position of the piston 30 to make small controlled changes in the disposition of the three members 24. The up and down movement and force is controlled by the air pressure in the cylinder. In FIG. 1 air is regulated in the cylinder 32 through the tube 34 by the bleed type pressure regulator 36.

One type regulator which can be used is a transducer for electronic/pneumatic interface type 50EI sold by Fischer & Porter Company in Warminster, Pennsylvania. This type regulator 36 allows one to control the tension in the roving as desired.

For example, a constant electrical signal could be supplied to the transducer 36 and so, a constant pneumatic signal would be transferred through the tube 34 to the cylinder 32. A constant force would thusly be biasing or pushing the three members 24 onto the roving. This constant biasing force would cause a constant amount of bending and contacting of the roving upon the members 24. But, as discussed earlier the tension in the roving is also effected by such things as the difficulty in pulling strand 10 from the packages 14 and the cleanliness of the members 24. These and other tensioning factors change during the winding of roving packages 46 and in the past have caused the tension in the roving as it travels to the collector 31 to vary out of control.

But with the tension control device 21 and a constant electric signal into the transducer 36 the factors tending to vary the tension in the roving are automatically compensated for.

For example, if during winding the members 24 become dirty (raising the coefficient of friction) and thus begin to raise the tension in the roving 20, the upward force on the three movable members 24 will be larger than the biasing force of the members 24 by the cylinder 32. This will cause the three members to move up until the forces are equal (the regulator 36 bleeding off air from the cylinder 32 to keep the downward force constant). When the members move up the bending and contact of the roving on the members would be lowered causing the tension in the roving to return to the desired level. The three members are thus yieldably biased into the roving. The bending and contact by the roving on the member is reduced when the members move up so that the tension in the roving would remain at the constant predetermined value while the coefficient of friction on the members 24 changes.

The tensioning device 21 can also be used to controllably vary the tension in the roving 20 traveling to the collector 31. By feeding different electrical signals into the transducer 36, the transducer 36 will send different pneumatic signals into the cylinder 32. Thus, the force yieldably biasing the movable members can be controllably varied by controllably varying the air pressure in the cylinder 32.

For example, the tension in the roving traveling to the collector could be raised as the diameter, of roving package increases as it is being wound. As shown in FIG. 1, as the roving package 46 becomes larger the support 48 moves back causing the potentiometer device 40 to change. The transducer 36 is connected to the potentiometer device 40 by a wire 38. When the potentiometer device changes (in response to package diameter change) the electrical signal into the transducer 36 will change causing the pneumatic signal from the transducer to change. The yieldable biasing force of the movable three members into the roving is controllably changed. As explained earlier this change in biasing force will cause a change in the tension in the roving 20 traveling along a path to the collector 31. Therefore, the tension in the roving can be regulated according to any desired program by supplying the desired program to the transducer 36.

Figure 3:
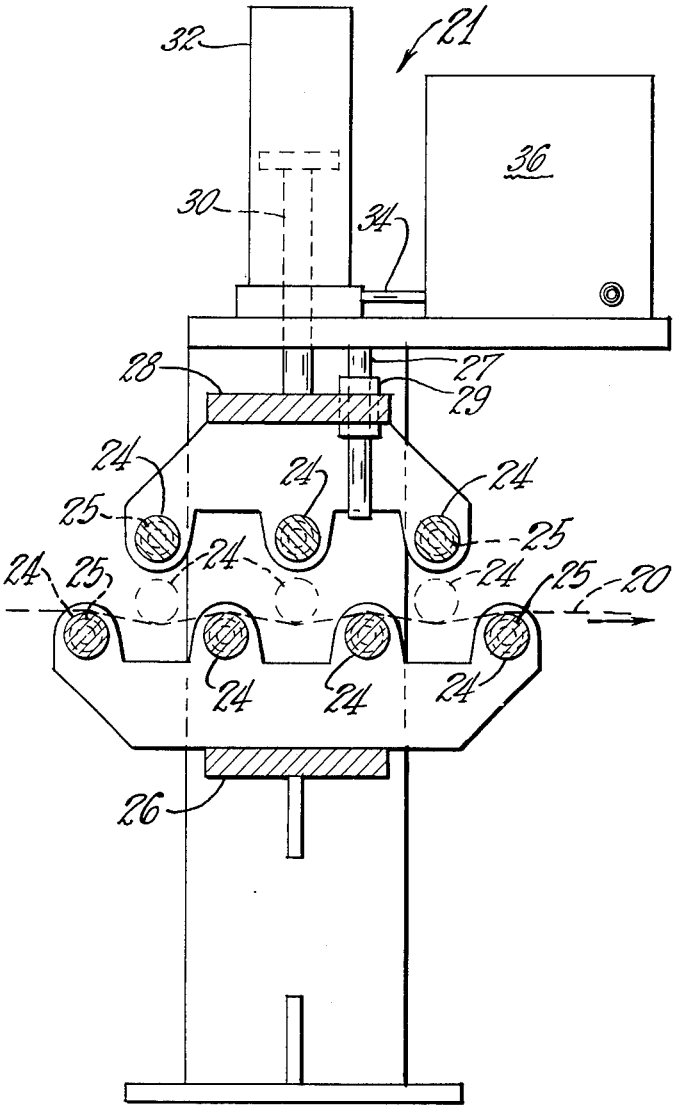
FIG. 3 is a, partially in section, enlarged front elevation view of the tensioning and control device.
Figure 2:
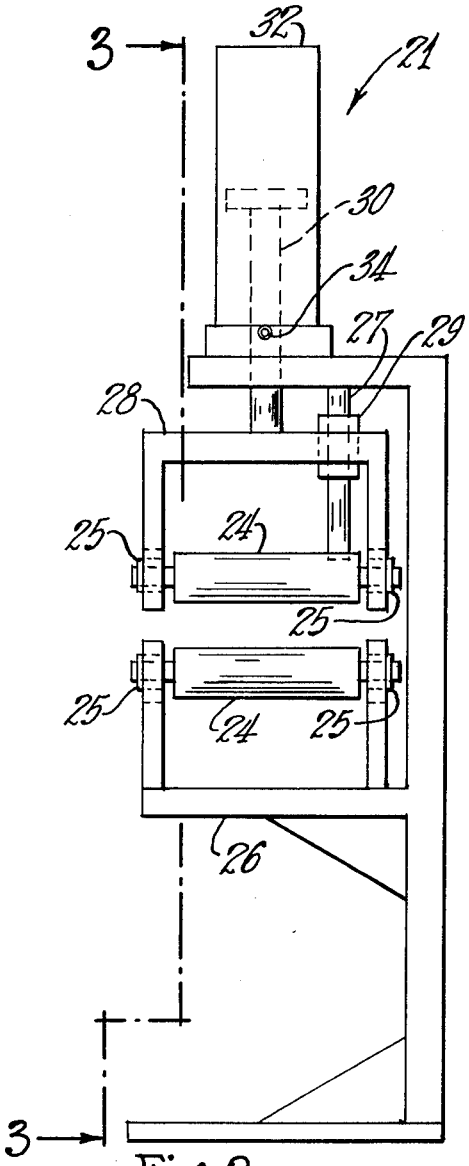
FIG. 2 is an enlarged and elevation view of the tensioning and control device.

In FIGS. 2 and 3 the tension controlling device 21 is in an open configuration for easy threading. The dashed members 24 and dashed roving 20 in FIG. 3 show the device 21 in an operational position like that shown in FIG. 1.

FIGS. 2 and 3 show a more detailed front and side view of the tension control device. The members 24 are all rotatably mounted in bushings 25 and are in parallel relationship with each other. The lower four members are supported on fixed axis by the support 26. The three upper members are movably held so that they are in movable relationship with the other members. As shown, the upper three members are attached to the piston 30 through the support 28 and the piston 30 moves up and down by the fixidly mounted cylinder 32. The cylinder, as explained earlier, yieldably biases the three members into the roving 20. A guide rod 27 attached to the cylinder 32 extends through a bushing 29 in the support 28 so the three members move only up and down. The bushing 29 can be a ball bearing type.

The roving travels along its path from the tension device 21 to the collector 31. The collector or winder shown in FIG. 1 is similar to the No. 959 constant yarn speed machine sold by Leesona Corporation of Warwick, Rhode Island. The roving 20 is turned by guide or turning bar 41 up to the traversing guide 50. The roving 20 is wound on a rotating tube 44 which is on a rotating collet 42. As the roving package 46 becomes larger the collet support 48 moves about the pivot 52 away from the traverse 50.

The collet 42 is rotated by the motor 60 through drive belts 54 and 56. The motor 60 is a variable speed motor. When the collet support 48 moves away from the traverse 50 it changes a potentiometer device 40 by moving a belt 58. The potentiometer 40 is connected to the motor by the wire 37. The speed of the motor 40 can be varied as the roving package 46 is being built so that the roving 20 is wound at a constant linear speed.

Although there is described above the principles of this invention in connection with a specific apparatus, it is to be clearly understood that this description is made only by way of example and not as a limitation to the scope of this invention.

I claim:

1. Apparatus for packaging roving from a plurality of continuous glass strands comprising:

a plurality of glass strand serving packages each mounted for linear withdrawal of a strand from one end thereof;

a rotatable collector spaced from the serving packages upon which the roving is wound as a package;

means for rotating the collector including speed control means for varying the angular speed of the collector during package collection so that the roving is wound at a constant linear collection speed, the speed control means including an electrical means effective to provide an electrical signal which varies in response to the changes of the diameter of the package during package collection;

gathering means between the packages and the collector for combining the strands into the roving;

means for tensioning the roving along its path to the collector including a first bar and a second bar in spaced relation located at opposite sides of the path and upon which the roving is turned during its travel along the path to the collector; and means for controlling the tension in the roving including means for holding the first bar on a fixed axis, pneumatic means including an air cylinder for movably holding the second bar in a biased relationship with the roving so that changes in the disposition of the second bar modifies the turning of the roving upon the bars to modify the tension in the roving, and a pressure control for regulating the air pressure in the cylinder, such control including means for sensing the varying electrical signal from the electrical means and for regulating the air pressure in response to the sensed signal.

2. The apparatus of claim 1 wherein the control means includes an electric-pneumatic transducer.

3. The apparatus of claim 1 wherein the pressure control varies the pressure in the air cylinder during package collection such that the tension in the roving is lowered as the package is collected.

4. The apparatus of claim 1 wherein the electrical means includes a potentiometer.

5. The apparatus of claim 1 wherein the electrical means includes a rheostat.

* * * * *